US011095979B2

(12) United States Patent
Katagiri

(10) Patent No.: US 11,095,979 B2
(45) Date of Patent: Aug. 17, 2021

(54) SOUND PICK-UP APPARATUS, RECORDING MEDIUM, AND SOUND PICK-UP METHOD

(71) Applicant: Oki Electric Industry Co., Ltd., Tokyo (JP)

(72) Inventor: Kazuhiro Katagiri, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 23 days.

(21) Appl. No.: 16/689,504

(22) Filed: Nov. 20, 2019

(65) Prior Publication Data

US 2020/0304907 A1 Sep. 24, 2020

(30) Foreign Application Priority Data

Mar. 20, 2019 (JP) ..... JP2019-053617

(51) Int. Cl.
*H04R 3/00* (2006.01)
*G10L 21/0232* (2013.01)
(Continued)

(52) U.S. Cl.
CPC ..... *H04R 3/005* (2013.01); *G10L 21/0232* (2013.01); *G10L 25/51* (2013.01);
(Continued)

(58) Field of Classification Search
CPC ..... H04R 3/005; H04R 1/406; H04R 29/005; H04R 2430/01; H04R 2430/20;
(Continued)

(56) References Cited

U.S. PATENT DOCUMENTS 9,549,255 B2 * 1/2017 Katagiri ..... H04R 1/326
10,453,471 B2 * 10/2019 Sugiyama ..... H04R 3/002
(Continued)

FOREIGN PATENT DOCUMENTS

JP 2014072708 A 4/2014
JP 2016127457 A 7/2016
(Continued)

OTHER PUBLICATIONS

Futoshi Asano, "Sound technology series 16: Array signal processing for acoustics: localization, tracking and separation of sound sources", The Acoustical Society of Japan Edition, Corona publishing Co. Ltd, publication date: Feb. 25, 2011, with its partial English translation.

*Primary Examiner* — Oyesola C Ojo
(74) *Attorney, Agent, or Firm* — Rabin & Berdo, P.C.

(57) ABSTRACT

The present invention relates to a sound pick-up apparatus. The sound pick-up apparatus according to the present invention includes: a unit configured to acquire target direction signals based on beamformer outputs of a plurality of microphone arrays; a unit configured to extract non-target area sound by performing spectral subtraction processing on the acquired target direction signals, and extract target area sound by performing spectral subtraction in a manner that a spectrum of the non-target area sound is subtracted from spectra of the target direction signals; a unit configured to perform target area sound determination processing for determining whether input signals include the target area sound; a unit configured to decide a level adjustment coefficient for adjusting a level of a mixing signal on the basis of an element including a result of the target area sound determination processing; and a unit configured to mix the extracted target area sound with a level-adjusted mixing signal obtained by adjusting the level of the mixing signal
(Continued)

with the decided level adjustment coefficient, and output a mixed signal as an area sound pick-up result.

12 Claims, 6 Drawing Sheets

(51) Int. Cl.
*H04R 29/00* (2006.01)
*H04R 1/40* (2006.01)
*G10L 25/51* (2013.01)

(52) U.S. Cl.
CPC ..... *H04R 1/406* (2013.01); *H04R 29/005* (2013.01); *H04R 2430/01* (2013.01)

(58) Field of Classification Search
CPC ..... G10L 21/0232; G10L 25/51; G10L 2021/02166; G10L 21/0208
See application file for complete search history.

(56) References Cited

U.S. PATENT DOCUMENTS

2005/0147258 A1* 7/2005 Myllyla ..... H01Q 3/2611 381/71.11
2008/0154592 A1* 6/2008 Tsujikawa ..... H04R 3/005 704/233
2009/0055170 A1* 2/2009 Nagahama ..... G10L 15/20 704/226
2016/0198258 A1* 7/2016 Katagiri ..... H04R 1/406 381/92
2017/0289677 A1* 10/2017 Katagiri ..... H04R 3/005

FOREIGN PATENT DOCUMENTS

JP 2017183902 A 10/2017
JP 2018037844 A 3/2018
JP 2018164156 A 10/2018

* cited by examiner

SOUND PICK-UP APPARATUS, RECORDING MEDIUM, AND SOUND PICK-UP METHOD

CROSS REFERENCE TO RELATED APPLICATION(S)

This application is based upon and claims benefit of priority from Japanese Patent Application No. 2019-053617, filed on Mar. 20, 2019, the entire contents of which are incorporated herein by reference.

BACKGROUND

The present invention relates to a sound pick-up apparatus, a recording medium, and a sound pick-up method. For example, the present invention is applicable to an area sound pick-up process that emphasizes sounds in a specific area and reduces sounds in the other areas.

Conventionally, as technology that collects and separates only sounds in a specific direction in an environment in which a plurality of sound sources are present, there is a beam former (which will be referred to as "BF") using microphone arrays. The BF is technology that forms directionality by using the time difference in signals arriving at the respective microphones (see Futoshi Asano (Author), "Sound technology series 16: Array signal processing for acoustics: localization, tracking and separation of sound sources," The Acoustical Society of Japan Edition, Corona publishing Co. Ltd, publication date: Feb. 25, 2011). The BF roughly comes in two types: an addition-type and a subtraction-type. In particular, a subtraction-type BF can advantageously form directionality with a smaller number of microphones as compared to an addition-type BF.

FIG. 5 is a block diagram illustrating a configuration of a subtraction-type BF 300 including two microphones.

The subtraction-type BF 300 illustrated in FIG. 5 includes a delayer 310 and a subtractor 320.

The subtraction-type BF 300 first uses the delayer 310 to calculate the signal time difference in sounds in a target direction (which will be referred to as "target sounds") which arrive at the respective microphones, and then obtains the target sounds in phase by adding delay. The time difference is calculated on the basis of the following expression (1). In the expression (1), "d" represents the distance between the microphones, "c" represents the speed of sound, and "$\tau_L$" represents the delay amount. Further, in the expression (1), "$\theta_L$" represents the angle from the vertical direction to the target direction with respect to the straight line connecting the microphones (M1 and M2).

$$\tau_L=(d \sin \theta_L)/c \tag{1}$$

Here, if there is a dead angle in the direction of the microphone M1 with respect to the center of the microphones M1 and M2, the delayer 310 performs delay processing on an input signal $x_1(t)$ of the microphone M1. Afterwards, the subtraction-type BF 300 uses the subtractor 320 to perform signal processing in accordance with an expression (2).

$$m(t)=x_2(t)-x_1(t-\tau_L) \tag{2}$$

The subtractor 320 can similarly perform subtraction processing in the frequency domain. In that case, the expression (2) is changed into the following expression (3).

$$M(\omega)=X_2(\omega)-e^{j\omega\tau_L}X_1(\omega) \tag{3}$$

FIG. 6 is a diagram illustrating a characteristic of directionality formed by the subtraction-type BF 300 using the two microphones M1 and M2.

Here, if $\theta_L=\pm\pi/2$, the subtractor 320 forms cardioid unidirectionality as illustrated in FIG. 6A. Meanwhile, if $\theta_L=0$ or $\pi$, the subtractor 320 forms 8-shaped bidirectionality as illustrated in FIG. 6B. Here, a filter that forms unidirectionality from input signals will be referred to as "unidirectional filter," and a filter that forms bidirectionality will be referred to as "bidirectional filter."

In addition, the subtractor 320 can form directionality that is strong in a dead angle of bidirectionality by using spectral subtraction (which will be referred to as "SS"). By using SS, the directionality is formed in all the frequency bands or a specified frequency band in accordance with an expression (4). The expression (4) uses an input signal $X_1$ of the microphone M1, but it is also possible to attain the similar advantageous effects by using an input signal $X_2$ of the microphone M2. In the expression (4), $\beta$ represents a coefficient for adjusting the strength of SS.

If (subtraction processing yields a negative value, the subtractor 320 performs flooring processing of replacing the negative value with 0 or a value obtained by reducing the original value. This method makes it possible to emphasize target sounds by causing the subtractor 320 to extract sounds in a direction other than a target direction (which will be referred to as "non-target sounds") with the bidirectional filter, and subtracting the amplitude spectrum of the extracted non-target sounds from the amplitude spectrum of the input signals.

$$Y(n)=X_1(n)-\beta M(n) \tag{4}$$

Meanwhile, in the case of collecting only sounds in a specific area (which will be referred to as "target area sounds") by using the subtraction-type BF alone, the subtraction-type BF would also probably collect sounds from a sound source around the area (which will be referred to as "non-target area sounds"). Accordingly, J P 2014-072708A proposes an area sound pick-up method that collects target area sounds by directing directionalities from different directions to a target area, and causing the directionalities to intersect in the target area with a plurality of microphone arrays.

When using the conventional area sound pick-up, the amplitude spectrum ratio of target area sounds included in the BF output of respective microphone arrays is first estimated, and then the ratio is used as a correction coefficient. For example, if two microphone arrays are used, the correction coefficient of the target area sound amplitude spectrum is calculated on the basis of a set of the following expressions (5) and (6), or a set of the following expressions (7) and (8).

$$\alpha_1(n) = \text{mode}\left(\frac{Y_{2k}(n)}{Y_{1k}(n)}\right) \; k = 1, 2, \ldots, N \tag{5}$$

$$\alpha_2(n) = \text{mode}\left(\frac{Y_{1k}(n)}{Y_{2k}(n)}\right) \; k = 1, 2, \ldots, N \tag{6}$$

$$\alpha_1(n) = \text{median}\left(\frac{Y_{2k}(n)}{Y_{1k}(n)}\right) \; k = 1, 2, \ldots, N \tag{7}$$

$$\alpha_2(n) = \text{median}\left(\frac{Y_{1k}(n)}{Y_{2k}(n)}\right) \; k = 1, 2, \ldots, N \tag{8}$$

In the expressions (5) to (8), "$Y_{1k}(n)$" and "$Y_{2k}(n)$" respectively represent the amplitude spectra of the BF outputs of the first and second microphone arrays. In addition, "N" represents the total number of frequency bins. "k" represents a frequency. In addition, "$\alpha_1(n)$" and "$\alpha_2(n)$"

represent the amplitude spectrum correction coefficients for the respective BF outputs of the first and second microphone arrays. Further, "mode" represents a mode value, and "median" represents a median value.

Afterwards, according to the conventional area sound pick-up processing, the respective BF outputs are corrected by using the correction coefficients and SS is performed, thereby extracting non-target area sounds in the target area direction. In addition, it is possible to extract target area sounds by further doing the SS in a manner that spectra of the extracted non-target area sounds are subtracted from spectra of the respective BF output.

In this case, according to the conventional area sound pick-up processing, in order to extract a non-target area sound $N_1(n)$ in the target area direction seen from a first microphone array, SS is done in a manner the spectrum of that a BF output $Y_2(n)$ of a second microphone array which has been multiplied by an amplitude spectrum correction coefficient $\alpha_2$ is subtracted from the spectrum of a BF output $Y_1(n)$ of the first microphone array as shown in the following expression (9). In a similar way, a non-target area sound $N_2(n)$ in the target area direction seen from the second microphone array is extracted in accordance with an expression (10).

$$N_1(n)=Y_1(n)-\alpha_2(n)Y_2(n) \tag{9}$$

$$N_2(n)=Y_2(n)-\alpha_1(n)Y_1(n) \tag{10}$$

Afterwards, according to the conventional area sound pick-up processing, SS is done in a manner that the spectrum of the non-target area sound is subtracted from the spectra of the respective BF outputs in accordance with expressions (11) and (12) to extract the target area sounds. The expression (11) represents processing of extracting a target area sound on the basis of the first microphone array. The expression (12) represents processing of extracting a target area sound on the basis of the second microphone array.

$$Z_1(n)=Y_1(n)-\gamma_1(n)N_1(n) \tag{11}$$

$$Z_2(n)=Y_2(n)-\gamma_2(n)N_2(n) \tag{12}$$

In the expressions (11) and (12), $\gamma_1(n)$ and $\gamma_2(n)$ represent coefficients for changing the strength at the time of SS.

According to the conventional area sound pick-up processing, SS, which is non-linear processing, is done in accordance with expressions (4), (11), and (12) to extract the target area sounds. This may cause discomfort noise which is referred to as musical noise in a high noise environment.

Therefore, the technology described in JP 2016-127457A makes it possible to reduce noise such as musical noise by determining a section that includes target area sound and section that does not includes target area sound in an input signal, and outputting no sound subjected to the area sound pick-up processing in the section that does not include target area sound. According to the technology described in JP 2016-127457A, an amplitude spectrum ratio R (=area sound output/input signal) between the input signal and an output obtained by extracting the target area sound (which will be referred to as "area sound output") is first calculated in accordance with an expression (13) in order to determine whether or not the target area sound is included. In addition, in the case where a target area includes a sound source, an input signal $X_1$ and an area sound output $Z_1$ include target area sound in common, and an amplitude spectrum ratio of a target area sound component is a value close to 1. On the other hand, a non-target area sound component is reduced in the area sound output. Therefore, a small value is obtained as an amplitude spectrum ratio. According to the area sound pick-up processing, the SS is performed multiple times with regard to another background noise component. Therefore, a non-target area sound component is reduced to some extent without performing exclusive noise reduction processing in advance, and a small value is obtained as an amplitude spectrum ratio. On the other hand, if the target area sound is not included, an area sound output includes only weak noise, which is residual sound, in comparison with the input signal. Therefore, small values are obtained in all bands as amplitude spectrum ratios. According to the above-described characteristics, the technology described in JP 2016-127457A generates a great difference between the case where the target area sound is included and the case where the target area sound is not included when taking an average value U of the amplitude spectrum ratios obtained with regard to respective frequencies in accordance with an expression (14). In the expression (14), m is an upper limit of a processing band (frequency band), and n is a lower limit of the processing band. For example, they are set to 100 Hz to 6 kHz to include sufficient sound information. In addition, according to the technology described in JP 2016-127457A, an average power spectrum ratio is determined by using a preset threshold. If it is determined that a target area sound is not included, area sound output data is not output, but no sound or sound obtained by reducing gain of an input signal is output.

$$R=\frac{Z_1}{X_1} \tag{13}$$

$$U=\frac{1}{n-m}\sum_{k=m}^{n}R_{1k} \tag{14}$$

In addition, JP 2017-183902A makes it possible to reduce an effect by adjusting respective sound volume levels of an input signal and estimated noise of a microphone in accordance with volumes of background noise and non-target area sound, mixing them with extracted target area sound, and masking musical noise. The processing of extracting target area sounds produces a stronger musical noise as the sound volume levels of background noise and non-target area sounds grow higher. Therefore, according to the technology described in JP 2017-183902A, the total sound volume level of input signals and estimated noise to mix is raised in proportion to the sound volume levels of background noise and non-target area sounds. In addition, according to the technology described in JP 2017-183902A, the sound volume level of background noise is calculated on the basis of estimated noise obtained in the processing of reducing the background noise. In addition, according to the technology described in JP 2017-183902A, the sound volume level of non-target area sounds is calculated on the basis of a combination of non-target area sound extracted through the expression (3) with non-target area sound extracted through the expressions (9) and (10). In addition, according to the technology described in JP 2017-183902A, the ratio of input signals to estimated noise to mix is decided on the basis of the sound volume levels of the estimated noise and non-target area sounds. If the sound volume level of input signals to mix is too high with non-target area sounds close to the target area, and there is no target area sound, only the non-target area sounds are heard. As a result, it is no longer possible to tell which is the target area sound. Therefore, according to the technology described in JP 2017-183902A, the sound volume level of input signals to mix is lowered and the sound volume level of estimated noise to mix is raised, the input signals, and the estimated noise are mixed in the case of loud non-target area sounds. In other words, if there is no non-target area sound or the sound volume level of non-target area sounds is low, input signals and estimated noise are mixed at an increased ratio of the input signals. Conversely, if the sound volume level of non-target area sounds is high, input signals and estimated noise are mixed at an increased ratio of the estimated noise. In addition to masking the musical noise, the method according to JP 2017-183902A attains advantageous effects of correcting the distortion of the target area sounds and improving the sound quality by using a target area sound component included in a microphone input signal.

However, although the method described in JP 2016-127457A makes it possible to reduce musical noise occurred in a high noise environment, it is impossible to improve distortion of a target area sound. In addition, according to the method described in JP 2016-127457A, sound is lost due to an erroneous determination if it is determined that the target area sound is not included and no sound is output. In addition, according to the method described in JP 2016-127457A, there is a possibility of binging a feeling of strangeness because sound becomes discontinuous between a distorted target area sound and an input signal when switching to the target area sound if it is determined that the target area sound is not included and a sound obtained by reducing the input signal is output.

On the other hand, the method described in JP 2017-183902A makes it possible to reduce an effect of musical noise occurred in a high noise environment, and improve distortion of a target area sound. However, according to the method described in JP 2017-183902A, the level of the mixed signal increases when both the levels of background noise and non-target area sound increase. Therefore, the method described in JP 2017-183902A includes a problem of attenuating the effect of noise reduction in a section that does not include a target area sound.

It is then desired to provide a sound pick-up apparatus, a recording medium, and a sound pick-up method that make it possible to suppress deterioration in sound quality at a time of the area sound pick-up processing.

According to the first invention of a sound pick-up apparatus including (1) a directionality formation unit configured to form directionalities in a target area direction in which a target area is present by using a beamformer with regard to respective input signals supplied by a plurality of microphone arrays or signals based on the respective input signals, and acquire respective target direction signals from the target area direction with regard to the plurality of microphone arrays, (2) a target area sound extraction unit configured to extract non-target area sound in the target area direction by performing spectral subtraction on the respective target direction signals, and extract target area sound by performing the spectral subtraction in a manner that a spectrum of the extracted non-target area sound is subtracted from a spectrum of any of the target direction signals, (3) a target area sound determination unit configured to determine whether a state of each of the input signals is a target area sound inclusion determination state where the input signal includes a component of the target area sound or a no target area sound inclusion determination state where the input signal does not include the component of the target area sound, on a basis of amplitude spectra of the input signal and the target area sound (4) a mixing level adjustment unit configured to decide a level adjustment coefficient for adjusting a level of a mixing signal to be mixed with the target area sound extracted by the target area sound extraction unit, on a basis of an element including a determination result of the target area sound determination unit, and (5) a mixing unit configured to mix the target area sound extracted by the target area sound extraction unit with a level-adjusted mixing signal obtained by adjusting the level of the mixing signal with the level adjustment coefficient decided by the mixing level adjustment unit, and output a mixed signal after mixing as an area sound pick-up result in the target area.

According to the second invention of a computer-readable non-transitory recording medium having recorded thereon a sound pick-up program that achieves functions of: (1) a directionality formation unit configured to form directionalities in a target area direction in which a target area is present by using a beamformer with regard to respective input signals supplied by a plurality of microphone arrays or signals based on the respective input signals, and acquire respective target direction signals from the target area direction with regard to the plurality of microphone arrays; (2) a target area sound extraction unit configured to extract non-target area sound in the target area direction by performing spectral subtraction on the respective target direction signals, and extract target area sound by performing the spectral subtraction in a manner that a spectrum of the extracted non-target area sound is subtracted from a spectrum of any of the target direction signals; (3) a target area sound determination unit configured to determine whether a state of each of the input signals is a target area sound inclusion determination state where the input signal includes a component of the target area sound or a no target area sound inclusion determination state where the input signal does not include the component of the target area sound, on a basis of amplitude spectra of the input signal and the target area sound; (4) a mixing level adjustment unit configured to decide a level adjustment coefficient for adjusting a level of a mixing signal to be mixed with the target area sound extracted by the target area sound extraction unit, on a basis of an element including a determination result of the target area sound determination unit; and (5) a mixing unit configured to mix the target area sound extracted by the target area sound extraction unit with a level-adjusted mixing signal obtained by adjusting the level of the mixing signal with the level adjustment coefficient decided by the mixing level adjustment unit, and output a mixed signal after mixing as an area sound pick-up result in the target area.

According to the third invention of a sound pick-up method, wherein (1) a directionality formation unit, a target area sound extraction unit, a target area sound determination unit, a mixing level adjustment unit, and a mixing unit are included, (2) the directionality formation unit forms directionalities in a target area direction in which a target area is present by using a beamformer with regard to respective input signals supplied by a plurality of microphone arrays or signals based on the respective input signals, and acquires respective target direction signals from the target area direction with regard to the plurality of microphone arrays, (3) the target area sound extraction unit extracts non-target area sound in the target area direction by performing spectral subtraction on the respective target direction signals, and extracts target area sound by performing the spectral subtraction in a manner that a spectrum of the extracted non-target area sound is subtracted from a spectrum of any of the target direction signals, (4) the target area sound determination unit determines whether a state of each of the input signals is a target area sound inclusion determination state where the input signal includes a component of the target area sound or a no target area sound inclusion determination state where the input signal does not include the component of the target area sound, on a basis of amplitude spectra of the input signal and the target area sound, (5) the mixing level adjustment unit decides a level adjustment coefficient for adjusting a level of a mixing signal to be mixed with the target area sound extracted by the target area sound extraction unit, on a basis of an element including a determination result of the target area sound determination unit, and (6) the mixing unit mixes the target area sound extracted by the target area sound extraction unit with a level-adjusted mixing signal obtained by adjusting the level of the mixing signal with the level adjustment coefficient decided by the mixing level adjustment unit, and outputs a mixed signal after mixing as an area sound pick-up result in the target area.

SUMMARY

According to the present invention it is possible to provide the sound pick-up apparatus, the recording medium, and the sound pick-up method that make it possible to suppress deterioration in sound quality at a time of area sound pick-up processing.

DETAILED DESCRIPTION OF THE EMBODIMENT(S)

Figure 1:
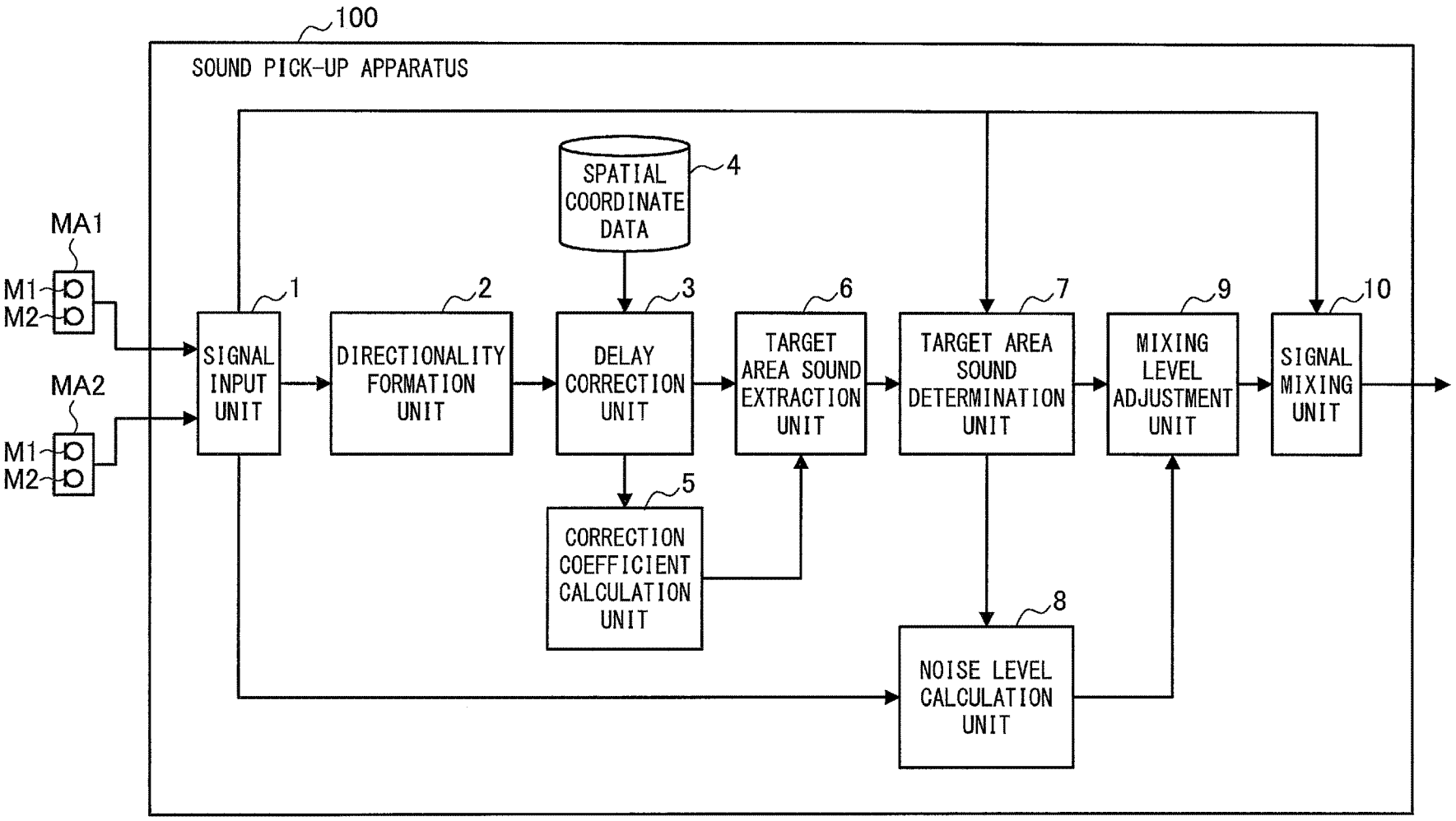
FIG. 1 is a block diagram illustrating a functional configuration of a sound pick-up apparatus according to a first embodiment.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

(A) First Embodiment

Hereinafter, a first embodiment of a sound pick-up apparatus, a sound pick-up program, and a sound pick-up method according to the present invention will be described with reference to drawings.

(A-1) Configuration According to First Embodiment

FIG. 1 is a block diagram illustrating a functional configuration of a sound pick-up apparatus 100 according to the first embodiment.

The sound pick-up apparatus 100 uses two microphone arrays MA (MA1 and MA2) to perform target area sound pick-up processing of collecting target area sounds from a sound source in a target area.

The microphone arrays MA1 and MA2 are disposed in given places in the space in which the target area is present. The microphone arrays MA1 and MA2 can be disposed at any positions with respect to the target area as long as the directionalities overlap with each other only in the target area. For example, the microphone arrays MA1 and MA2 may be disposed to face each other across the target area. Each of the microphone arrays MA includes two or more microphones M, and collects an acoustic signal through each of the microphones M. The present embodiment will be described on the assumption that two microphones M1 and M2 for collecting acoustic signals are disposed in each of the microphone arrays MA. In other words, in the present embodiment, each of the microphone arrays MA composes a 2-*ch* microphone array. The distance between the two microphones M1 and M2 is not limited. In the example according to the present embodiment, the distance between the two microphones M1 and M2 is assumed to be 3 cm. Note that the number of microphone arrays MA is not limited to two. If there are a plurality of target areas, it is necessary to dispose a sufficient number of the microphone arrays MA to cover all of the areas.

Next, an internal configuration of the sound pick-up apparatus 100 will be described with reference to FIG. 1 and FIG. 2.

As illustrated in FIG. 1, the sound pick-up apparatus 100 includes a signal input unit 1, a directionality formation unit 2, a delay correction unit 3, spatial coordinate data 4, a correction coefficient calculation unit 5, a target area sound extraction unit 6, a target area sound determination unit 7, a noise level calculation unit 8, a mixing level adjustment unit 9, and a signal mixing unit 10.

The sound pick-up apparatus 100 may be entirely configured with hardware (such as an exclusive chip), or may be configured with software (program) for a part or all. The sound pick-up apparatus 100 may be configured, for example, by installing a program (including a sound pick-up program according to an embodiment) in a computer including a processor and memory.

Next, a hardware configuration of the sound pick-up apparatus 100 will be described with reference to FIG. 2.

Figure 2:
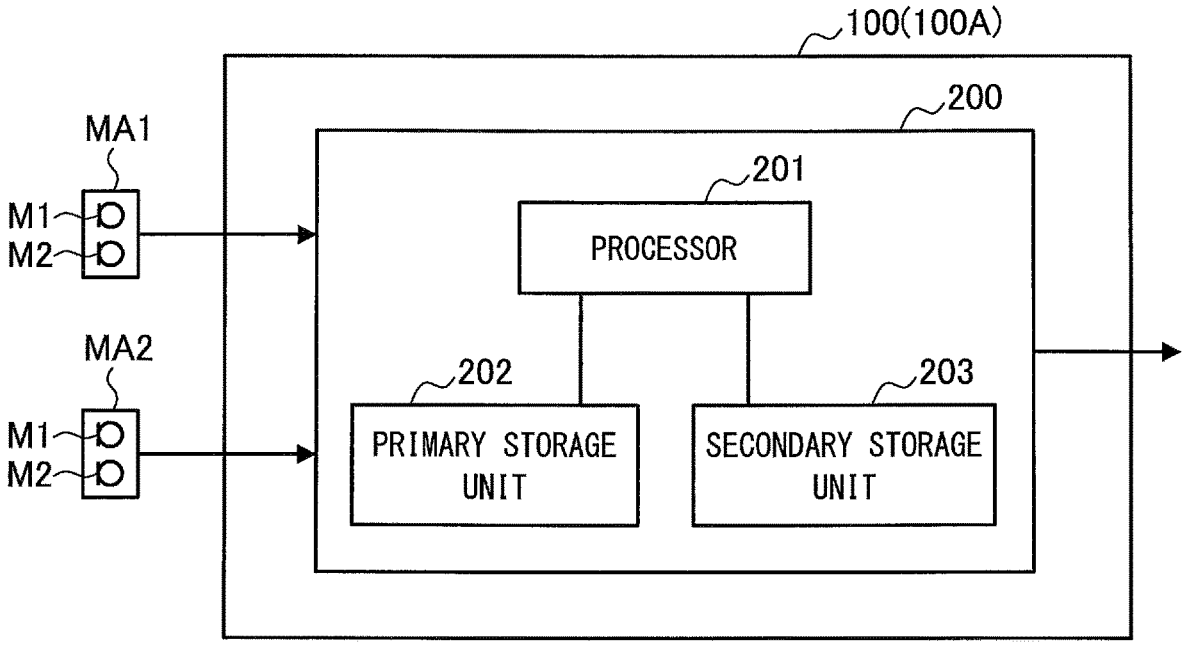
FIG. 2 is a block diagram illustrating an example of a hardware configuration of a sound pick-up apparatus according to the first embodiment and a second embodiment.

FIG. 2 is a block diagram illustrating an example of the hardware configuration of the sound pick-up apparatus 100.

The sound pick-up apparatus 100 may be entirely configured with hardware (such as an exclusive chip), or may be configured with software (program) for a part or all. The sound pick-up apparatus 100 may be configured, for example, by installing a program (including a sound pick-up program according to an embodiment) in a computer including a processor and memory. Moreover, it may be possible to provide a computer-readable non-transitory recording medium having the sound pick-up program recorded thereon.

FIG. 2 illustrates an example of a hardware configuration when the sound pick-up apparatus is configured by using software (a computer).

The sound pick-up apparatus 100 illustrated in FIG. 2 includes a computer 200 in which programs (including the sound pick-up program according to the present embodiment) are installed as a hardware structural element. In addition, the computer 200 may be a computer dedicated to the sound pick-up program, or may be configured to be shared with a program of another function.

The computer 200 illustrated in FIG. 2 includes a processor 201, a primary storage unit 202, and a secondary storage unit 203. The primary storage unit 202 is a storage means that functions as work memory of the processor 201. For example, high-speed operation memory such as dynamic random-access memory (DRAM) is applicable. The secondary memory 203 is a storage means for recoding various kinds of data such as an operating system (OS) and program data (including data of the sound pick-up program according to the present embodiment). For example, non-volatile memory such as FLASH memory or an HDD is applicable. When the processor 201 is activated, the computer 200 according to the present embodiment reads the OS or the program (the sound pick-up program according to the present embodiment) recorded on the secondary storage unit 203, and deploys and executes it on the primary storage unit 202.

Note that, the specific configuration of the computer 200 is not limited to the configuration illustrated in FIG. 2. Various kinds of configurations are applicable. For example, it is possible to omit the secondary storage unit 203 if the primary storage unit 202 is the non-volatile memory (such as FLASH memory, for example).

(A-2) Operation According to First Embodiment

Next, operation of the sound pick-up apparatus 100 according to the first embodiment configured as described above (a sound pick-up method according to the present embodiment) will be described.

To the signal input unit 1, acoustic signals collected through the respective microphone arrays MA (MA1 and MA2) are input. Subsequently, the signal input unit 1 converts the acoustic signals from analog signals to digital signals. Afterwards, the signal input unit 1 converts the acoustic signals (the digital signals) from the time domain to the frequency domain by using a predetermined method (for example, fast Fourier transform). Hereinafter, the respective input signals of the microphones M1 and M2 of the microphone arrays MA in the frequency domain are referred to as $X_1$ and $X_2$.

The directionality formation unit 2 uses a BF and forms directionalities in a target area direction in accordance with the expression (4) with regard to the input signals of the respective microphone arrays. Hereinafter, respective amplitude spectra of BF outputs of the microphone arrays MA1 and MA2 are referred to as $Y_{1k}(n)$ and $Y_{2k}(n)$.

The delay correction unit 3 calculates and corrects the delay caused by the difference in the distances between the target area and the respective microphone arrays. First of all, the delay correction unit 3 acquires the positions of the target area and each of the microphone arrays from the spatial coordinate data 4, and then calculates the difference in arrival time between the target area sounds arriving at the respective microphone arrays. Next, the delay correction unit 3 adds delay in a manner that the target area sounds concurrently arrive at all the microphone arrays on the basis of a microphone array disposed at the farthest position from the target area.

The spatial coordinate data 4 contains positional information on all the target areas, respective microphone arrays, and microphones included in each of the microphone arrays.

The correction coefficient calculation unit 5 calculates correction coefficients for equalizing the amplitude spectra of the target area sound components included in the respective BF outputs. Hereinafter, respective correction coefficients of the BF outputs of the microphone arrays MA1 and MA2 are referred to as $\alpha_1(n)$ and $\alpha_2(n)$. The correction coefficient calculation unit 5 calculates the correction coefficients in accordance with a set of the expressions (5) and (6) or a set of the expressions (7) and (8).

The target area sound extraction unit 6 extracts the non-target area sounds in the target area direction from the respective BF outputs corrected with the correction coefficients calculated by the correction coefficient calculation unit 5. Next, the target area sound extraction unit 6 does SS in accordance with the expression (9) or (10) with regard to the respective pieces of BF output data corrected with the correction coefficients calculated by the correction coefficient calculation unit 5 to extract non-target area sound ($N_1(n)$ or $N_2(n)$) in the target area direction.

In addition, the target area sound extraction unit 6 extracts target area sound ($Z_1(n)$ or $Z_2(n)$) by doing SS in accordance with the expression (11) or (12) in a manner that the spectrum of the extracted non-target area sound ($N_1(n)$ or $N_2(n)$) is subtracted from the spectra of the respective BF outputs.

The target area sound determination unit 7 performs processing of determining whether or not an input signal includes target area sound (which will be referred to as "target area sound determination processing"). If it is determined that the input signal includes the target area sound through the target area sound determination processing, the target area sound determination unit 7 outputs data (a signal) indicating that "the target area sound is included". If it is determined that the input signal does not include the target area sound, the target area sound determination unit 7 outputs data (a signal) indicating that "the target area sound is not included". Hereinafter, a state where the target area sound determination unit 7 outputs the data indicating that "the target area sound is included" (a state where it is determined that the input signal includes the target area sound) is referred to as a "target area sound inclusion determination state". A state where the target area sound determination unit 7 outputs the data indicating that "the target area sound is not included" (a state where it is determined that the input signal does not include the target area sound) is referred to as a "no target area sound inclusion determination state".

The method of the target area sound determination processing performed by the target area sound determination unit 7 is not limited. Various kinds of methods are applicable. In the present embodiment, the target area sound determination unit 7 performs the target area sound determination processing by using the method described in JP2016-127457A. For example, the target area sound determination unit 7 finds an amplitude spectrum ratios of the target area sound to the input signal with regard to respective frequencies in accordance with the expression (13), and finds an average value U of the amplitude spectrum ratios R found with regard to the respective frequencies in accordance with the expression (14). Next, the target area sound determination unit 7 compares U with a preset threshold, and determines whether or not the target area sound is included.

The noise level calculation unit 8 calculates the level of the input signal obtained when the target area sound determination unit 7 determines that "the target area sound is not included", as an estimated noise level which will be referred to as an "estimated noise level $P_N$"). For example, the noise level calculation unit 8 may acquire the level of the input signal when the target area sound determination unit 7 determines that "the target area sound is not included" once, as the estimated noise level $P_N$. Alternatively, for example, the noise level calculation unit 8 may acquire input signals when the target area sound determination unit 7 determines that "the target area sound is not included" multiple times, and the noise level calculation unit 8 may acquire an average value (an average level) thereof as the estimated noise level $P_N$. In addition, if the average value of the input levels obtained multiple times is acquired as the estimated noise level $P_N$, the noise level calculation unit 8 may set a forgetting coefficient and weight past signals and a current signals (a lower weight is applied as a signal is older in chronological order).

Alternatively, the noise level calculation unit 8 calculates an input signal obtained when the target area sound determination unit 7 determines that "the target area sound is included", as an estimated level of a tentative target area sound (a simply estimated target area sound) (which will be referred to as a "tentative target area sound estimation level $P_T$"). For example, the noise level calculation unit 8 may acquire the level of an input signal when the target area sound determination unit 7 determines that "the target area sound is included" once, as the tentative target area sound estimation level $P_T$. Alternatively, the noise level calculation unit 8 may acquire input levels when the target area sound determination unit 7 determines that "the target area sound is included" multiple times, and the noise level calculation unit 8 may acquire an average value (an average level) thereof as the tentative target area sound estimation level $P_T$.

Note that, in this case, the noise level calculation unit 8 desirably calculates the estimated noise level $P_N$ and the tentative target area sound estimation level $P_T$ by using similar methods. For example, if the noise level calculation unit 8 acquires the level of the input signal when the target area sound determination unit 7 determines that "the target area sound is not included" once, as the estimated noise level $P_N$, the noise level calculation unit 8 desirably acquires the level of the input signal when the target area sound determination unit 7 determines that "the target area sound is included" once, as the tentative target area sound estimation level $P_T$, in a similar way.

Next, the noise level calculation unit 8 applies the estimated noise level $P_N$ and the tentative target area sound estimation level $P_T$ to the following expression (15), and calculates a simple S/N ratio Q.

$$Q = \frac{P_T - P_N}{P_N} \tag{15}$$

The mixing level adjustment unit 9 decides a coefficient for adjusting the level of a mixing signal (which will be referred to as a "level adjustment coefficient") in view of an element including the determination result of the target area sound determination unit 7. In other words, the mixing level adjustment unit 9 may vary the level adjust coefficient on the basis of whether the determination result of the target area sound determination unit 7 indicates the state where "the target area sound is included" (the target area sound inclusion determination state) or the state where "the target area sound is not included" (the no target area sound inclusion determination state). For example, the mixing level adjustment unit 9 may preliminarily set different level adjustment coefficients for the state where "the target area sound is included" and the state where "the target area sound is not included". Alternatively, the mixing level adjustment unit 9 may make it possible to change the level adjustment coefficient to be applied in response to user operation (such as operation performed by a user on the computer 200).

As described above, for the mixing level adjustment unit 9, a policy of deciding a level adjustment coefficient in view of an element including a determination result of the target area sound determination unit 7 is set.

Figure 3:
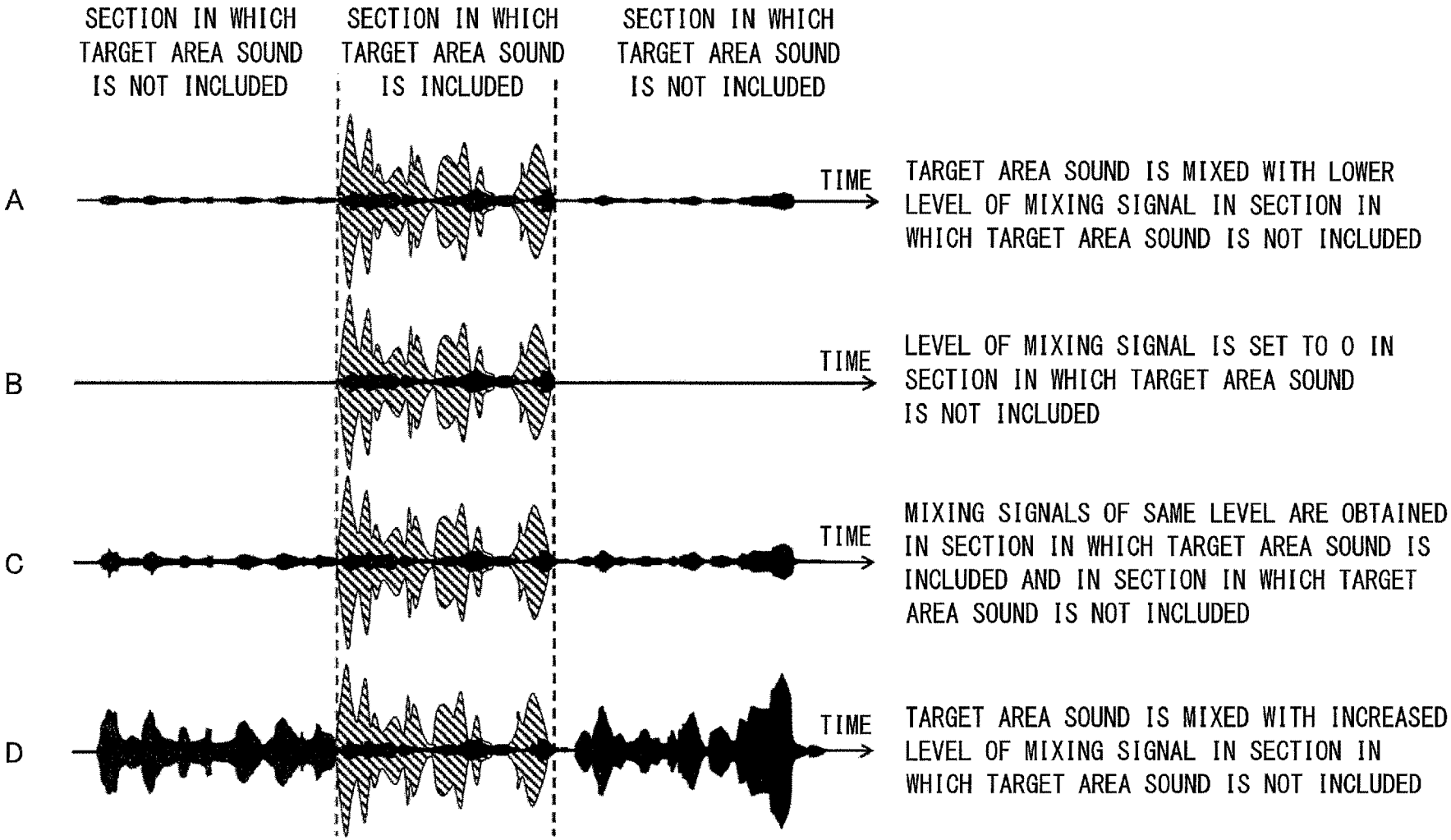
FIG. 3 is a diagram illustrating examples of signals mixed by the sound pick-up apparatus according to the first embodiment.

FIG. 3 is a graph illustrating mixing signals corresponding to policies used by the mixing level adjustment unit 9 to decide level adjustment coefficients (mixing signals obtained after adjustment based on the level adjustment coefficients) together with target area sounds (target area sounds extracted by the target area sound extraction unit 6) in the time domain. In FIG. 3, components of the target area sounds are hatched with solid lines, and components of the mixing signals are filled with black.

For example, the mixing level adjustment unit 9 may decide a level adjustment coefficient in a manner that a higher mixing signal level is obtained in the state where "the target area sound is included" than the state where "the target area sound is not included". For example, the mixing level adjustment unit 9 may decide a level adjustment coefficient in a manner that a value of a mixing signal level obtained in the state where "the target area sound is not included" is 10 dB smaller than a value of a mixing signal level obtained in the case where "the target area sound is included". In this case, target area sound and an adjusted mixing signal are illustrated in FIG. 3A.

Alternatively, for example, the mixing level adjustment unit 9 may decide a level adjustment coefficient in a manner that the level of a mixing signal is set to 0 in the state where "the target area sound is not included" as illustrated in FIG. 3B.

Alternatively, for example, sometimes the mixing level adjustment unit 9 may adjust a level adjustment coefficient in a manner that the same mixing level is eventually obtained in the state where "the target area sound is included" and in the state where "the target area sound is not included", as illustrated in FIG. 3C. For example, the mixing level adjustment unit 9 decides level adjustment coefficients by using different policies between the state where "the target area sound is included" and the state where "the target area sound is not included", but, as a result, sometimes the level adjustment coefficients become identical to each other under a certain condition.

Alternatively, for example, the mixing level adjustment unit 9 may decide a level adjustment coefficient in a manner that a higher mixing signal level is obtained in the state where "the target area sound is not included" than the state where "the target area sound is included". For example, the mixing level adjustment unit 9 may decide a level adjustment coefficient in a manner that a value of a mixing signal level obtained in the state where "the target area sound is not included" is 10 dB larger than a value of a mixing signal level obtained in the case where "the target area sound is included". In this case, target area sound and an adjusted mixing signal are illustrated in FIG. 3D. In the case of FIG. 3D, output sound is the same as the input signal if the target area sound is not included. However, if the target area sound is included, the noise is reduced and this achieves an advantageous effect of emphasizing the target area sound.

In addition, for example, the mixing level adjustment unit 9 may set level adjustment coefficients at all frequencies to a same value, or may set them to different values at the respective frequencies. Specifically, for example, when the mixing level adjustment unit 9 sets level adjustment coefficients at a certain frequency k or lower to 0, this makes it possible to achieve the same advantageous effect as an advantageous effect obtained when a high-pass filter is applied to a mixing signal.

In addition, for example, the mixing level adjustment unit 9 may dynamically change a level adjustment coefficient in view of the S/N ratio Q or the estimated noise level $P_N$ calculated by the noise level calculation unit 8. For example, if the S/N ratio Q is low (for example, if the S/N ratio Q is lower than a predetermined threshold), the level of noise included in the input signal tends to be high, and musical noise and distortion of target area sound extracted by the target area sound extraction unit 8 tend to be large. Therefore, if the S/N ratio Q is low in the state where "the target area sound is included", the mixing level adjustment unit 9 may adjust a level adjustment coefficient in a manner that the mixing signal level gets higher (for example, a value corresponding to a certain level is added to the level adjustment coefficient). Alternatively, if the S/N ratio Q is high (for example, if the S/N ratio Q is more than or equal to a predetermined threshold), the musical noise and distortion of the target area sound extracted by the target area sound extraction unit 6 are tend to be small. Therefore, if the S/N ratio Q is high, the mixing level adjustment unit 9 may adjust a level adjustment coefficient in a manner that the mixing signal level becomes lower (for example, a value corresponding to a certain level is subtracted from the level adjustment coefficient) in any of the state where "the target area sound is included" and the state where "the target area sound is not included".

The signal mixing unit 10 multiplies the input signal by the level adjustment coefficient set by the mixing level adjustment unit 9, and outputs an output signal mixed with the target area sound extracted by the target area sound extraction unit 6. Hereinafter, the output signal output from the signal mixing unit 10 is referred to as "W". Note that, hereinafter, "$W_1$" represents an output signal generated by using the target area sound $Z_1$ based on the microphone array MA1, and "$W_2$" represents an output signal generated by using the target area sound $Z_2$ based on the microphone array MA2.

For example, if the target area sound extraction unit 6 performs the area sound pick-up processing on the basis of the microphone array MA1 in accordance with the expression (11), the final output signal $W_1$ to be output from the signal mixing unit 10 is generated (mixed) in accordance with the following expression (16). In the expression (16), $X_{MIX}$ represents an input signal, and μ represents a level adjustment coefficient. In addition, ρ represents a parameter for adjusting the volume of target area sound.

Note that, if the target area sound extraction unit 6 performs the area sound pick-up processing on the basis of the microphone array MA2 in accordance with the expression (12), the final output signal $W_2$ to be output from the signal mixing unit 10 is generated (mixed) in accordance with the following expression (17).

$$W_1=\rho Z_1+\mu X_{MIX} \tag{16}$$

$$W_2=\rho Z_2+\mu X_{MIX} \tag{17}$$

In addition, for example, if the target area sound determination unit 7 determines that "the target area sound is not included", the signal mixing unit 10 may set ρ to 0, and, as a result, only a component of the mixing signal $X_{MIX}$ may be output. This makes it possible to completely suppress occurrence of the musical noise in the output signal W. In other words, as a result, the sound pick-up apparatus 100 may be configured to output only the mixing signal. Alternatively, for example, if the target area sound determination unit 7 determines that "the target area sound is included", the signal mixing unit 10 makes it possible to stabilize an output level by dynamically changing p in a manner that a constant average amplitude spectrum of the target area sound is obtained.

(A-3) Advantageous Effect According to First Embodiment

The following advantageous effects can be achieved according to the first embodiment.

The sound pick-up apparatus 100 according to the first embodiment sets the level of a mixing signal (an input signal according to the first embodiment) to be mixed with target area sound by deciding level adjustment coefficients in accordance with different policies for a section in which the input signal includes the target area sound and a section in which the input signal does not include the target area sound, and then mixes the input signal with the target area sound as the mixing signal. This makes it possible for the sound pick-up apparatus 100 according to the first embodiment to achieve an advantageous effect of reducing an effect of musical noise on an output signal after the mixing, an advantageous effect of improving the sound quality of the target area sound, an advantageous effect of suppressing commingling of noise when the target area sound is not included, and other advantageous effects.

In addition, the sound pick-up apparatus 100 according to the first embodiment uses a same mixing signal (the input signal according to the first embodiment) for the section in which the target area sound is included and the section in which the target area sound is not included. This makes it possible to naturally emphasize the target area sound.

(B) Second Embodiment

Hereinafter, a second embodiment of a sound pick-up apparatus, a sound pick-up program, and a sound pick-up method according to the present invention will be described with reference to drawings.

(B-1) Configuration According to Second Embodiment

Figure 4:
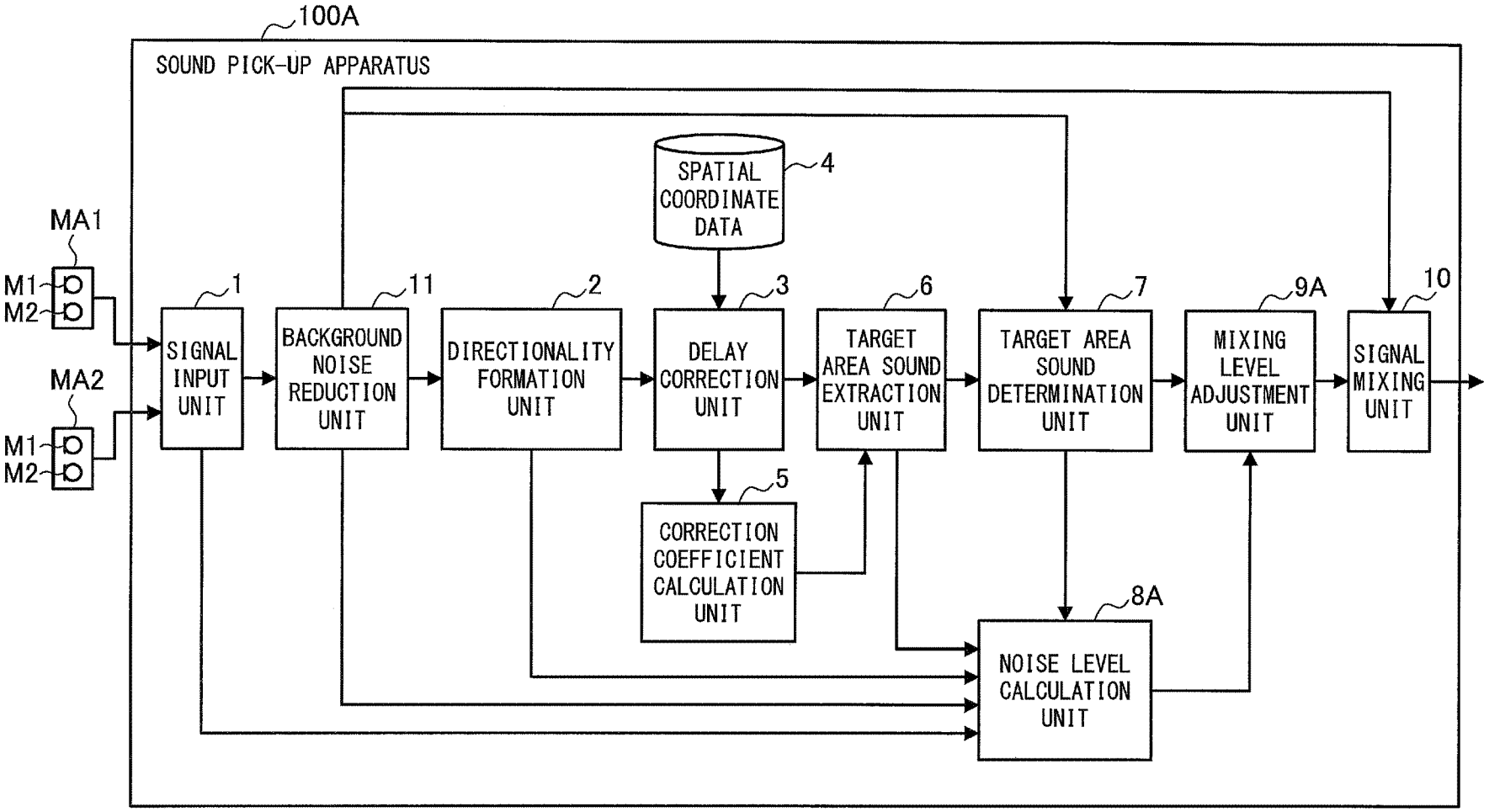
FIG. 4 is a block diagram illustrating a functional configuration of a sound pick-up apparatus according to a second embodiment.
Figure 5:
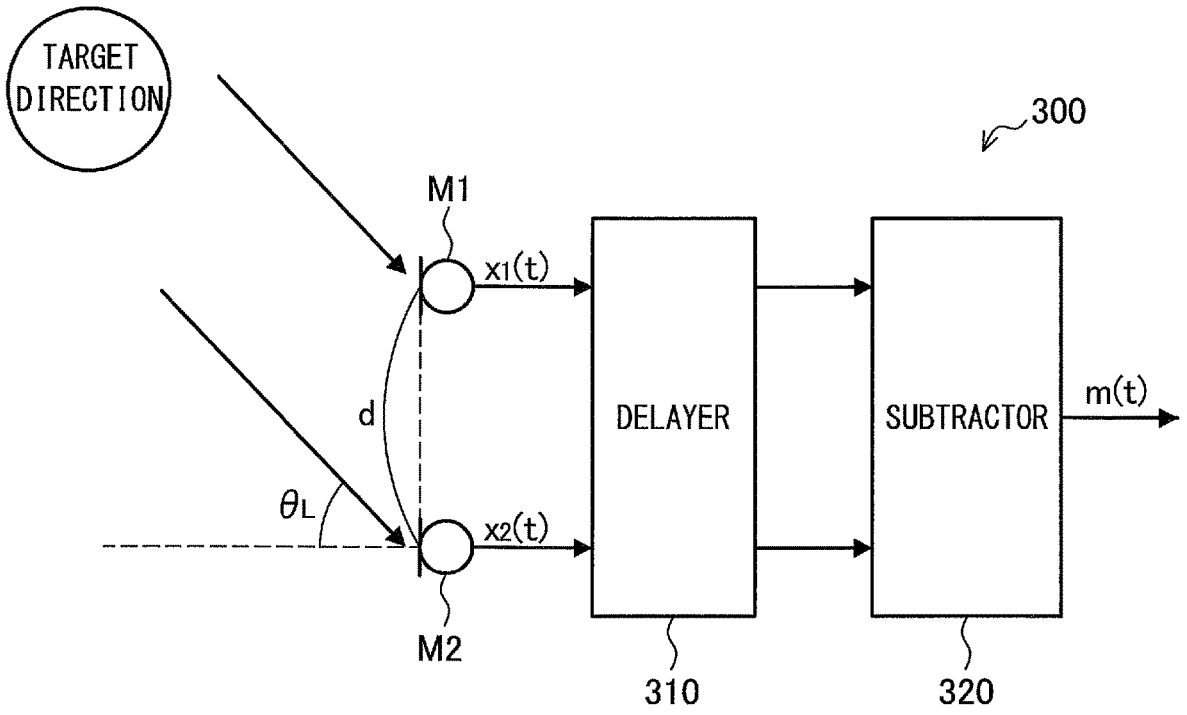
FIG. 5 is a block diagram illustrating a configuration of a conventional subtraction-type BF.
Figure 6A:
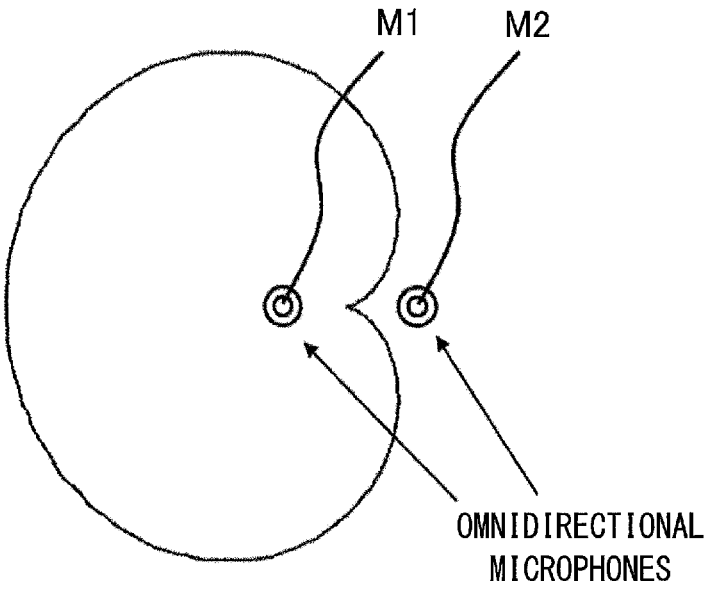
FIG. 6A is an explanatory diagram illustrating an example of a directional filter formed by the conventional subtraction-type BF.
Figure 6B:
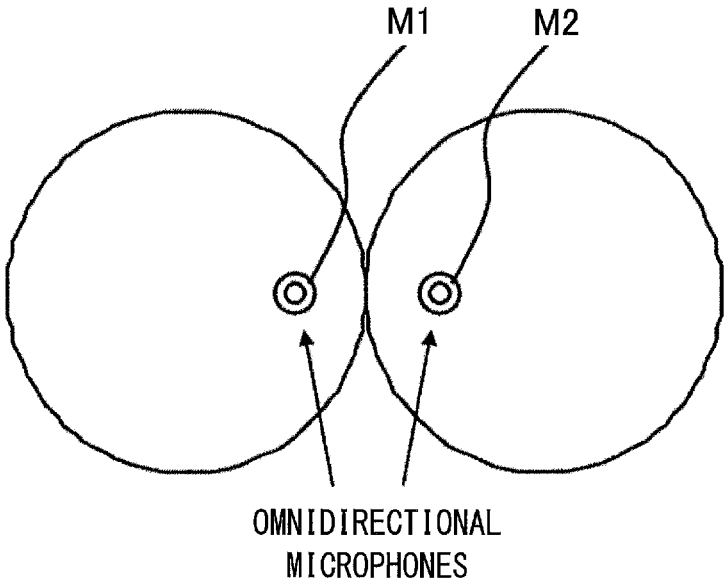
FIG. 6B is an explanatory diagram illustrating an example of a directional filter formed by the conventional subtraction-type BF.

FIG. 4 is a block diagram illustrating a functional configuration of a sound pick-up apparatus 100A according to the second embodiment. In FIG. 4, structural elements that are same as or correspond to the structural elements illustrated in FIG. 1 described above are denoted with reference signs that are same as or correspond to the reference signs of the structural elements illustrated in FIG. 1.

Hereinafter, the sound pick-up apparatus 100A according to the second embodiment will be described while focusing on differences from the first embodiment.

If a conventional sound pick-up apparatus is used in the case where an input signal includes much background noise, there are a possibility that musical noise occurs and a possibility that distortion of target area sound gets larger when extracting the target area sound. Therefore, the sound pick-up apparatus 100A according to the second embodiment reduces the background noise in the input signal and then extracts the target area sound. In addition, the sound pick-up apparatus 100A according to the second embodiment uses an input signal with suppressed background noise as a mixing signal. This makes it possible to suppress commingling of the background noise with the output signal W after mixing.

Specifically, the sound pick-up apparatus 100A according to the second embodiment is different from the first embodiment in that a background noise reduction unit 11 is added, the noise level calculation unit 8 is replaced with a noise level calculation unit 8A, and the mixing level adjustment unit 9 is replaced with a mixing level adjustment unit 9A.

(B-2) Operation According to Second Embodiment

Next, operation of the sound pick-up apparatus 100A according to the second embodiment configured as described above (a sound pick-up method according to the present embodiment) will be described.

The background noise reduction unit 11 estimates a component of background noise (such as components other than human voice) included in a signal acquired by the signal input unit 1 (hereinafter, an estimation result will be referred to as "estimated background noise"), reduces it, and outputs an input signal the after noise reduction (which will be referred to as "noise-reduced input signal). The method of the noise reduction processing performed by the background noise reduction unit 11 is not limited. For example, SS or Wiener filtering can be used.

The target area sound determination unit 7 according to the second embodiment performs target area sound determination processing on the basis of the amplitude spectrum of the noise-reduced input signal (the input signal obtained after the background noise reduction unit 11 reduces the background noise) and target area sound extracted by the target area sound extraction unit 6.

The noise level calculation unit 8A calculates an S/N ratio of the target area sound to the estimated noise level (S represents the target area sound, N represents noise other than the target area sound, and the S/N ratio is hereinafter referred to as a "first S/N ratio") in a way similar to the first embodiment, and calculates an S/N ratio of the estimated background noise extracted by the background noise reduction unit 11 to the target area sound extracted by the target area sound extraction unit 6 (S represents an average amplitude spectrum of target area sounds, N represents an average amplitude spectrum of estimated background noises, and the S/N ratio is hereinafter referred to as a "second S/N ratio"). In addition, the noise level calculation unit 8A also calculates an S/N ratio of non-target sound extracted by the directionality formation unit 2 to non-target area sound extracted by the target area sound extraction unit 6 (S represents an average amplitude spectrum of target area sounds, N represents an average amplitude spectrum of non-target area sounds and non-target sounds, and the S/N ratio is hereinafter referred to as a "third S/N ratio").

The mixing level adjustment unit 9A may set a mixing signal level coefficient in a way similar to the first embodiment, and may set mixing signal level coefficients in view of various kinds of S/N ratios (the second and third S/N ratios) calculated by the noise level calculation unit 8A. For example, if the second S/N ratio (S represents the target area sound, and N represents the estimated background noise) is compared with the third S/N ratio (S represents the target area sound, and N represents the non-target sound and the non-target area sound) and the third S/N ratio is larger than the second S/N ratio, an effect of commingling of the non-target sound and the non-target area sound is larger than an effect of musical noise or distortion. Therefore, the mixing level adjustment unit 9A may adjust a mixing signal level in a weaker manner that a low mixing signal level is obtained (for example, a value corresponding to a certain level is subtracted from a level adjustment coefficient) in the state where "the target area sound is included".

The signal mixing unit 10 according to the second embodiment uses the noise-reduced input signal (the input signal obtained after the background noise reduction unit 11 reduces the background noise) as a mixing signal, mixes it with the target area sound in accordance with the expression (16), and obtains an output signal W.

(B-3) Advantageous Effect According to Second Embodiment

The second embodiment can achieve the following advantageous effects in comparison with the advantageous effects according to the first embodiment.

The sound pick-up apparatus 100A according to the second embodiment performs the background noise reduction processing on an input signal and then extracts target area sound. This makes it possible to suppress occurrence of musical noise and distortion of the target area sound.

In addition, the sound pick-up apparatus 100A according to the second embodiment uses an input signal with suppressed background noise (a noise-reduced input signal) as a mixing signal. This makes it possible to suppress commingling of the background noise with the output signal W after mixing.

In addition, the sound pick-up apparatus 100A according to the second embodiment makes it possible to extract noise components other than the target area sound as background noise, non-target sound, and non-target area sound. This makes it possible to calculate S/N ratios (the first to third S/N ratios) with regard to the respective noise components, and adjust mixing levels in accordance with noise environments.

(C) Other Embodiments

The present invention is not limited the above-described embodiments. The present invention can be applied to modified embodiments exemplified as follows.

(C-1) In the above-described embodiments, the delay correction unit 3 and the spatial coordinate data 4 are not essential, and may be omitted. For example, if delay does not occur or is ignorable from the beginning because of the layout of the microphone arrays MA and the target area sounds, the processing to be performed by the delay correction unit 3 and the spatial coordinate data 4 may be omitted.

(C-2) In the above-described embodiments, the correction coefficient calculation unit 5 is not essential, and may be omitted. For example, the processing to be performed by the correction coefficient calculation unit 5 may be omitted if it is clear that a difference between amplitude spectra of target area sounds captured by the respective microphones M (microphones M included in each of the microphone arrays MA) is small because of the layout of the microphone arrays MA and the target area sounds.

(C-3) In the above-described embodiments, the noise level calculation unit 8 may be omitted if the level adjustment coefficient is decided regardless of the S/N ratio Q (the first S/N ratio).

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

What is claimed is:

1. A sound pick-up apparatus comprising:

a directionality formation unit configured to form directionalities in a target area direction in which a target area is present by using a beamformer with regard to respective input signals supplied by a plurality of microphone arrays or signals based on the respective input signals, and acquire respective target direction signals from the target area direction with regard to the plurality of microphone arrays;

a target area sound extraction unit configured to extract non-target area sound in the target area direction by performing spectral subtraction on the respective target direction signals, and extract target area sound by performing the spectral subtraction in a manner that a spectrum of the extracted non-target area sound is subtracted from a spectrum of any of the target direction signals;

a target area sound determination unit configured to determine whether a state of each of the input signals is a target area sound inclusion determination state where the input signal includes a component of the target area sound or a no target area sound inclusion determination state where the input signal does not include the component of the target area sound, on a basis of amplitude spectra of the input signal and the target area sound;

a mixing level adjustment unit configured to decide a level adjustment coefficient for adjusting a level of a mixing signal to be mixed with the target area sound extracted by the target area sound extraction unit, on a basis of an element including a determination result of the target area sound determination unit;

a mixing unit configured to mix the target area sound extracted by the target area sound extraction unit with a level-adjusted mixing signal obtained by adjusting the level of the mixing signal with the level adjustment coefficient decided by the mixing level adjustment unit, and output a mixed signal after mixing as an area sound pick-up result in the target area; and a noise level calculation unit configured to calculate a first S/N ratio on a basis of the input signals and the determination results of the target area sound determination unit, wherein the mixing level adjustment unit decides the level adjustment coefficient also in view of the first S/N ratio, and, in a case where the first S/N ratio is smaller than a threshold and the state of the input signal is the target area sound inclusion determination state, the mixing level adjustment unit makes an adjustment by adding the level adjustment coefficient.

2. The sound pick-up apparatus according to claim 1, wherein the mixing level adjustment unit decides different values as the level adjustment coefficient between a case where the determination result of the target area sound determination unit indicates the target area sound inclusion determination state, and a case where the determination result of the target area sound determination unit indicates the no target area sound inclusion determination state.

3. The sound pick-up apparatus according to claim 2, wherein, in a case where the determination result of the target area sound determination unit indicates the no target area sound inclusion determination state, the mixing level adjustment unit decides the level adjustment coefficient that is a smaller value than a case where the determination result of the target area sound determination unit indicates the target area sound inclusion determination state.

4. The sound pick-up apparatus according to claim 1, wherein, in a case where the first S/N ratio is greater than or equal to a threshold, the mixing level adjustment unit makes an adjustment by subtracting the level adjustment coefficient.

5. The sound pick-up apparatus according to claim 1, wherein the mixing signal is the input signal.

6. The sound pick-up apparatus according to claim 1, further comprising a background noise reduction unit configured to perform background noise reduction processing for reducing background noise of the respective input signals and generate background-noise-reduced input signals, wherein the directionality formation unit forms directionalities in the target area direction in which the target area is present by using the beamformer with regard to the respective background-noise-reduced input signals generated by the background noise reduction unit, and acquires the respective target direction signals from the target area direction with regard to the plurality of microphone arrays, and the mixing signal is the background-noise-reduced input signal generated by the background noise reduction unit.

7. The sound pick-up apparatus according to claim 6, wherein the background noise reduction unit estimates background noise included in the input signal during processing, and acquires it as estimated background noise, the directionality formation unit extracts non-target sound in a direction other than the target area direction, from the input signal during the processing, and the mixing level adjustment unit makes an adjustment by subtracting the level adjustment coefficient in the target area sound inclusion determination state in a case where a third S/N ratio is greater than a second S/N ratio, the second SN ratio being based on the target area sound extracted by the target area sound extraction unit and the estimated background noise acquired by the background noise reduction unit, the third S/N ratio being based on the target area sound extracted by the target area sound extraction unit and a signal obtained by adding the non-target area sound acquired by the target area sound extraction unit and the non-target sound acquired by the directionality formation unit.

8. A computer-readable non-transitory recording medium having recorded thereon a sound pick-up program that achieves functions of:

a directionality formation unit configured to form directionalities in a target area direction in which a target area is present by using a beamformer with regard to respective input signals supplied by a plurality of microphone arrays or signals based on the respective input signals, and acquire respective target direction signals from the target area direction with regard to the plurality of microphone arrays;

a target area sound extraction unit configured to extract non-target area sound in the target area direction by performing spectral subtraction on the respective target direction signals, and extract target area sound by performing the spectral subtraction in a manner that a spectrum of the extracted non-target area sound is subtracted from a spectrum of any of the target direction signals;

a target area sound determination unit configured to determine whether a state of each of the input signals is a target area sound inclusion determination state where the input signal includes a component of the target area sound or a no target area sound inclusion determination state where the input signal does not include the component of the target area sound, on a basis of amplitude spectra of the input signal and the target area sound;

a mixing level adjustment unit configured to decide a level adjustment coefficient for adjusting a level of a mixing signal to be mixed with the target area sound extracted by the target area sound extraction unit, on a basis of an element including a determination result of the target area sound determination unit;

a mixing unit configured to mix the target area sound extracted by the target area sound extraction unit with a level-adjusted mixing signal obtained by adjusting the level of the mixing signal with the level adjustment coefficient decided by the mixing level adjustment unit, and output a mixed signal after mixing as an area sound pick-up result in the target area; and a noise level calculation unit configured to calculate a first S/N ratio on a basis of the input signals and the determination results of the target area sound determination unit, wherein the mixing level adjustment unit decides the level adjustment coefficient also in view of the first S/N ratio, and, in a case where the first S/N ratio is smaller than a threshold and the state of the input signal is the target area sound inclusion determination state, the mixing level adjustment unit makes an adjustment by adding the level adjustment coefficient.

9. A sound pick-up method, for a sound pick-up apparatus including a directionality formation unit, a target area sound extraction unit, a target area sound determination unit, a mixing level adjustment unit, a mixing unit and a noise level calculation unit, the method comprising:

forming, by the directionality formation unit, directionalities in a target area direction in which a target area is present by using a beamformer with regard to respective input signals supplied by a plurality of microphone arrays or signals based on the respective input signals, and acquiring respective target direction signals from the target area direction with regard to the plurality of microphone arrays;

extracting, by the target area sound extraction unit, non-target area sound in the target area direction by performing spectral subtraction on the respective target direction signals, and extracting target area sound by performing the spectral subtraction in a manner that a spectrum of the extracted non-target area sound is subtracted from a spectrum of any of the target direction signals;

determining, by the target area sound determination unit, whether a state of each of the input signals is a target area sound inclusion determination state where the input signal includes a component of the target area sound or a no target area sound inclusion determination state where the input signal does not include the component of the target area sound, on a basis of amplitude spectra of the input signal and the target area sound;

deciding, by the mixing level adjustment unit, a level adjustment coefficient for adjusting a level of a mixing signal to be mixed with the target area sound extracted by the target area sound extraction unit, on a basis of an element including a determination result of the target area sound determination unit;

mixing, by the mixing unit the target area sound extracted by the target area sound extraction unit with a level-adjusted mixing signal obtained by adjusting the level of the mixing signal with the level adjustment coefficient decided by the mixing level adjustment unit, and outputting a mixed signal after mixing as an area sound pick-up result in the target area; and calculating, by the noise level calculation unit, a first S/N ratio on a basis of the input signals and the determination results of the target area sound determination unit, wherein the mixing level adjustment unit decides the level adjustment coefficient also in view of the first S/N ratio, and, in a case where the first S/N ratio is smaller than a threshold and the state of the input signal is the target area sound inclusion determination state, the mixing level adjustment unit makes an adjustment by adding the level adjustment coefficient.

10. The sound pick-up apparatus according to claim 1, wherein the noise level calculation unit calculates an estimated noise level and a tentative target area sound estimation level using the input signals based on whether the target area sound is included in the input signals or not in accordance with the determination results of the target area sound determination unit, and calculates the first S/N ratio as being $(P_T-P_N)/P_N$, wherein $P_N$ is the estimated noise level, and $P_T$ is the tentative target area sound estimation level.

11. The computer-readable non-transitory recording medium according to claim 8, wherein the noise level calculation unit calculates an estimated noise level and a tentative target area sound estimation level using the input signals based on whether the target area sound is included in the input signals or not in accordance with the determination results of the target area sound determination unit, and calculates the first S/N ratio as being $(P_T-P_N)/P_N$, wherein $P_N$ is the estimated noise level, and $P_T$ is the tentative target area sound estimation level.

12. The sound pick-up method according to claim 9, further comprising:

calculating, by the noise level calculation unit, an estimated noise level and a tentative target area sound estimation level using the input signals based on whether the target area sound is included in the input signals or not in accordance with the determination results of the target area sound determination unit, and calculating, by the noise level calculation unit, the first S/N ratio as being $(P_T-P_N)/P_N$, wherein $P_N$ is the estimated noise level, and $P_T$ is the tentative target area sound estimation level.

* * * * *